US005738236A

United States Patent [19]

Brun, Jr.

[11] Patent Number: 5,738,236

[45] **Date of Patent: *Apr. 14, 1998**

[54] RECYCLABLE CONTAINER AND ROTATABLE CLOSURE OF PLASTICS MATERIAL

[75] Inventor: Charles J. Brun, Jr., Xenia, Ohio

[73] Assignee: Electra Form, Inc., Vandalia, Ohio

[ * ] Notice: The term of this patent shall not extend beyond the expiration date of Pat. No. 5,449,085.

[21] Appl. No.: 798,977

[22] Filed: Feb. 11, 1997

Related U.S. Application Data

[63] Continuation of Ser. No. 524,341, Sep. 6, 1995, Pat. No. 5,601,203, which is a continuation of Ser. No. 209,704, Mar. 14, 1994, Pat. No. 5,449,085.

[51] Int. Cl.[6] ..... B65D 47/02; B65D 51/18

[52] U.S. Cl. ..... 220/253; 220/256; 220/336; 215/309; 222/548

[58] Field of Search ..... 220/253, 256, 220/336, 345, 703, 711, 301, 717, 718; 215/222, 309, 313, 343, 345, DIG. 1; 222/548, 545, 561, 482, 542

[56] References Cited

U.S. PATENT DOCUMENTS

| | | | |
|---|---|---|---|
| 2,796,191 | 6/1957 | Belanger . | |
| 3,788,651 | 1/1974 | Brown et al. . | |
| 3,880,313 | 4/1975 | Akers . | |
| 4,054,205 | 10/1977 | Blow, Jr. et al. . | |
| 4,190,173 | 2/1980 | Mason et al. | 220/303 X |
| 4,203,527 | 5/1980 | LaChance, Sr. | 220/253 |
| 4,383,619 | 5/1983 | Mumford et al. . | |
| 4,444,328 | 4/1984 | Glass . | |
| 4,548,331 | 10/1985 | Montgomery | 220/253 |
| 4,550,850 | 11/1985 | Smith et al. | 220/253 |
| 4,717,039 | 1/1988 | Ayyoubi . | |
| 4,726,478 | 2/1988 | Zimmermann . | |
| 4,790,444 | 12/1988 | Terzi . | |
| 4,832,219 | 5/1989 | Nycz | 220/253 X |
| 4,930,658 | 6/1990 | McEldowney . | |
| 5,064,086 | 11/1991 | McEntee | 220/253 |
| 5,123,574 | 6/1992 | Poulos | 220/253 X |
| 5,145,085 | 9/1992 | Yost . | |
| 5,203,467 | 4/1993 | Tucker . | |
| 5,269,432 | 12/1993 | Beckertgis | 220/253 |
| 5,294,014 | 3/1994 | Wyatt et al. | 220/253 |
| 5,320,233 | 6/1994 | Welch . | |
| 5,449,085 | 9/1995 | Brun, Jr. | 220/256 X |
| 5,601,203 | 2/1997 | Brun, Jr. | 220/253 |

FOREIGN PATENT DOCUMENTS

| | | | |
|---|---|---|---|
| 1185853 | 8/1959 | France | 220/253 |

*Primary Examiner*—Allan N. Shoap
*Assistant Examiner*—Nathan Newhouse
*Attorney, Agent, or Firm*—Jacox, Meckstroth & Jenkins

[57] ABSTRACT

A blow molded plastics container includes an injection molded annular neck portion which is sealed by injection molding to an annular wall portion of an injection molded top end wall having a part-spherical center portion. The center portion has five circumferentially spaced and upwardly projecting annular lip seals, two of which surround openings within the top end wall. An injection molded rotatable closure snap-fits onto the neck portion and has a mating part-spherical center portion which engages the lip seals. The closure has one opening which is selectively and progressively alignable with the annular lip seals in response to indexing the closure in one direction. An integrally molded one-way latch extends between the center portions of the closure and top end wall and prevents reverse rotation of the closure except between a consumer open position and a sealed reclosable position.

14 Claims, 2 Drawing Sheets

RECYCLABLE CONTAINER AND ROTATABLE CLOSURE OF PLASTICS MATERIAL

RELATED APPLICATIONS

This application is a contination of application Ser. No. 08/524,341, filed Sep. 6, 1995, U.S. Pat. No. 5,601,203, which is a continuation of application Ser. No.08/209,704 filed Mar. 14, 1999, U.S. Pat. No. 5,449,085.

BACKGROUND OF THE INVENTION

In the art of easy open carbonated beverage containers, it is common to use a one piece aluminum can having an open top which is covered by and seamed to an aluminum shell or lid, for example, as disclosed in numerous patents issued to Ermal C. Fraze and in U.S. Pat. No. 4,930,658. These patents disclose a top end wall or shell having a section defined by a score or tear line which is ruptured by lifting or tilting a pull tab attached to the section by an integrally formed rivet. An aluminum lid with an easy open tear section has also been used in combination with a container or can which is blow molded of polyethylene terephthalate (PET) material to obtain the advantages of a transparent plastics container. However, due to the aluminum top end wall or lid attached to a blow molded plastics body or can, it was not practical to recycle the container, and the manufacture of the container has been discontinued.

It has been found desirable to produce a beverage container which is stackable and is constructed entirely of PET material or a compatible plastics material so that the container is recyclable. Such a container must be capable of holding substantial pressure over an extended period of time such as required to hold a carbonated beverage. It is also desirable for the all plastics container to provide for easy opening by the consumer and also for reclosing in a sealed condition so that a portion of a carbonated beverage or contents may be preserved in the container.

Various devices have been used or proposed for reclosing an aluminum beverage container with an easy open lid section deflected by a pull or tilt tab. For example, U.S. Pat. No. 4,054,205 discloses a cup-shaped vessel which snap-fits onto the top of an aluminum beverage can and is rotatable to open and close the opening within the top end wall or shell of the can. Another form of closure device of molded plastics material is disclosed in U.S. Pat. No. 5,145,085. In this patent, a container has a top end wall molded of a plastics material, and a pivotal closure section may be reclosed after a flangeable seal has been ruptured. However, neither of these container attachments are capable of resealing and retaining substantial pressure within the container, for example, as is produced by a carbonated beverage after it is reclosed within its container. It is also known to provide rotatable closures on non-pressurized containers such as on containers for spices and other similar granular materials. In addition, U.S. Pat. No. 4,717,039 discloses a metal container with a rotatable semi-circular metal cap for reclosing a pressurized beverage container having an easy open feature to provide a spill-resistant seal around the opening.

SUMMARY OF THE INVENTION

The present invention is directed to an improved all plastics recyclable container which is capable of retaining a pressurized fluid, such as a carbonated beverage, and which provides for easy opening of the container. In addition, the container of the invention provides for convenient reclosing of the opening and for holding a pressurized fluid or beverage within the reclosed container.

In accordance with one embodiment of the invention, the above features are provided by a blow molded plastics or PET container which includes an annular neck coupled and sealed to an annular wall portion of an injection molded top end wall having a part-spherical center portion. The center portion has a series of circumferentially spaced and upwardly projecting annular lip seals, two of which surround circular openings within the top end wall. A rotatable plastics closure snap-fits onto the neck portion and has a mating part-spherical center portion which engages the lip seals. The closure has one opening which is selectively and progressively alignable with the annular lip seals in response to indexing the closure in one direction. An integrally molded one-way latch extends between the center portions of the closure and top end wall and prevents reverse rotation of the closure except between a consumer opened position and a sealed reclosable position.

Other features and advantages of the invention will be apparent from the following description, the accompanying drawings and the appended claims.

DESCRIPTION OF THE PREFERRED EMBODIMENT

Figure 1:
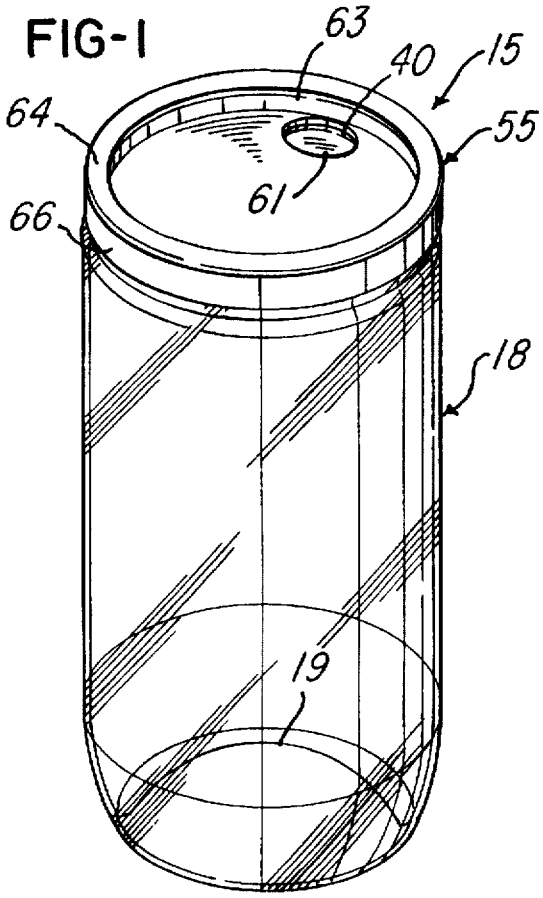
FIG. 1 is a perspective view of an all plastics container constructed in accordance with the invention.

FIG. 1 illustrates an all plastics recyclable beverage container 15 which is constructed entirely of recyclable PET material. The container 15 includes a blow molded can or body 18 which may be transparent and includes an upwardly projecting dome-shaped or part-spherical bottom end wall 19. The body 18 also includes an injection molded annular neck 22 (FIG. 10) having a cylindrical portion 24 which defines a circular open top for the container body 18. A set of axially spaced peripheral flanges 26 and 28 project outwardly from the cylindrical portion 24, and the flange 26 cooperates with the cylindrical portion 24 to define a peripherally extending groove or recess 29.

The open top end of the container body 18 is closed by a top end wall 30 which includes a dome-shaped or part-cylindrical center portion 32 surrounded by an integrally molded cylindrical portion 33 and an outwardly projecting peripheral flange 36. The cylindrical portion 33 of the top end wall 30 fits snugly against the cylindrical neck portion 24, and the flange 36 of the top end wall seats on the upper flange 28 of the neck 22.

Figure 2:
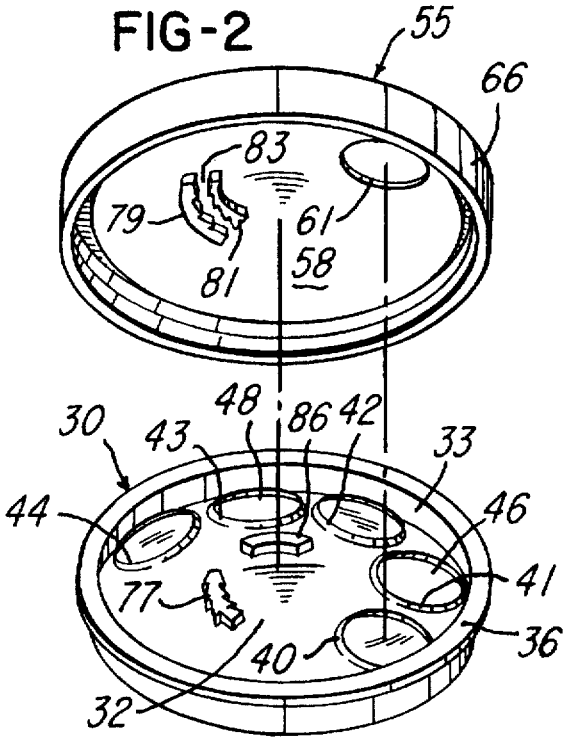
FIG. 2 is an exploded perspective view of the rotary closure and top end wall of the container shown in FIG. 1.
Figure 10:
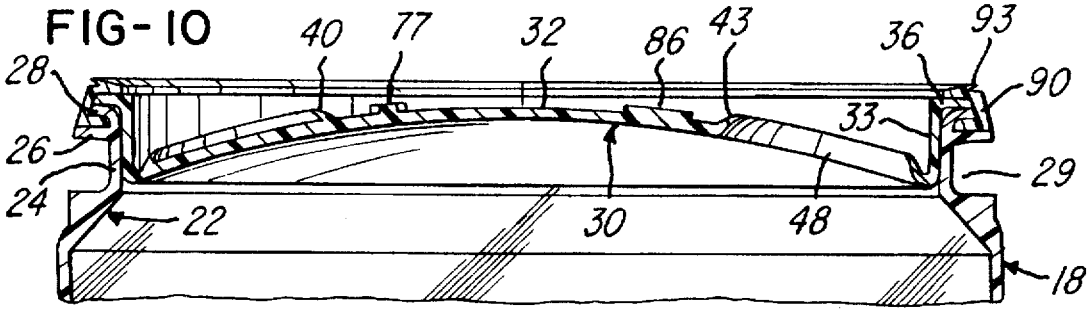
FIG. 10 is a fragmentary section of only the container body and attached top end wall, as also shown in FIG. 8.

As best shown in FIGS. 2 and 10, the top end wall 30 is molded with a plurality of five circumferentially spaced annular lip seals 40–44 each of which is tapered to be slightly resilient and flexible. The lip seals are angularly spaced at increments of 45 degrees, and the lip seals 40 and 43 surround corresponding circular holes or openings 46 or 48 within the top end wall. The upper edges of the lip seals 40–44 lie within a part-spherical plane parallel to the curvature of the part-spherical center portion 32 of the top end wall.

Figure 9:
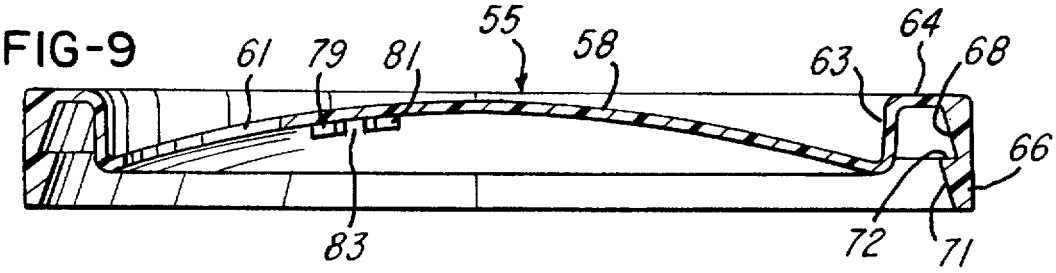
FIG. 9 is a section of only the closure shown in FIG. 8.

An injection molded rotatable closure 55 includes a crowned or part-spherical center portion 58 in which is formed a single circular hole or opening 61 (FIGS. 1 and 9). The center portion 58 is surrounded by an integrally molded cylindrical wall portion 63, an outwardly projecting peripheral rim portion 64 and a downwardly projecting annular skirt portion 66. The skirt portion 66 has an upper tapered or frusto-conical annular surface 68 and a similar lower surface 71 which cooperate to form an annular radial surface or shoulder 72.

The closure 55 and the top end wall 30 also have an integrally molded and ratchet type one-way latch 75 which is formed by an arcuate step-like latch element 77 having opposite teeth and projecting upwardly from the top end wall 30. A pair of arcuate and radially spaced latch elements 79 and 81 are molded as an integral part of the closure 55 and project downwardly to define a mating step-like arcuate cavity 83. As shown in FIG. 2, the center portion 32 of the top end wall 30 also includes an integrally molded arcuate bar or stop element 86 which projects upwardly from the center portion 32 of the top end wall adjacent the lip seal 43.

Figure 8:
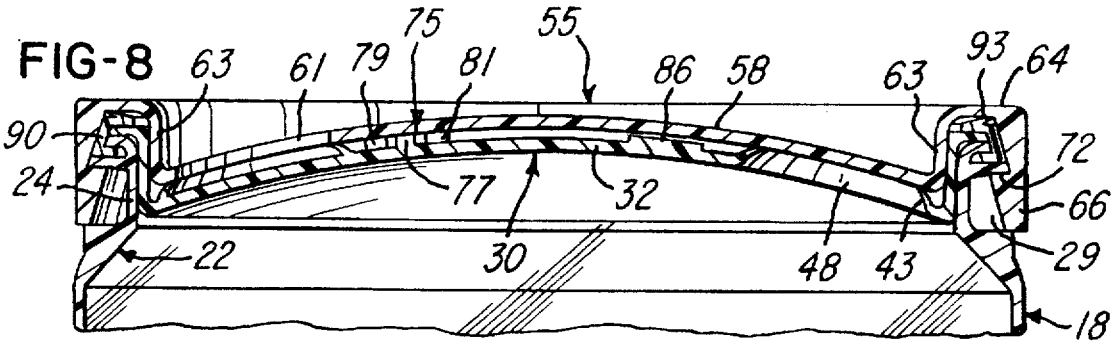
FIG. 8 is an enlarged fragmentary section of the container as taken generally on the line 8—8 of FIG. 3.

Referring to FIG. 10, an annular ring 90 is injection molded around the flanges 28 and 36 of the container body 18 and the top end wall 10 to form a positive fluid-tight connection of the flanges 28 and 36. The ring 90 is also molded with a tapered annular lip seal 93 which projects upwardly and outwardly from the top annular wall of the molded ring 90. As shown in FIG. 8, after the ring 90 is molded around the flanges 26, 28 and 36 (FIG. 10), the closure 55 is pressed downwardly onto the ring 90 causing the skirt portion 66 of the closure to spring outwardly until the shoulder 72 snaps in under the flange 26 for locking the closure 55 onto the top end wall and neck 22 of the container body 18. When the lower annular part of the skirt portion 66 snaps into the annular recess 29, the closure 55 is positively locked onto the container body 18 but is free to rotate.

When the closure 55 is assembled onto to the top end wall 30, the lip seal 93 forms a rotary seal between the closure 55 and molded ring 90 to prevent any liquid from seeping around the skirt portion 66 and into the gap or space defined between the closure 55 and top end wall 30. During the assembly, the stepped latch element 77 also snaps into the stepped latch cavity 83 in the position shown in FIG. 3 where the opening 61 within the closure 55 is aligned with the annular lip seal 40. Also, when the closure 55 is assembled onto the container body neck portion 22, as shown in FIG. 8, the part-spherical center portion 58 of the closure 55 engages and slightly deforms the annular lip seals 40–44 to form a fluid-tight seal between each lip seal 40–44 and the mating part-spherical bottom surface of the closure 55.

Figure 3:
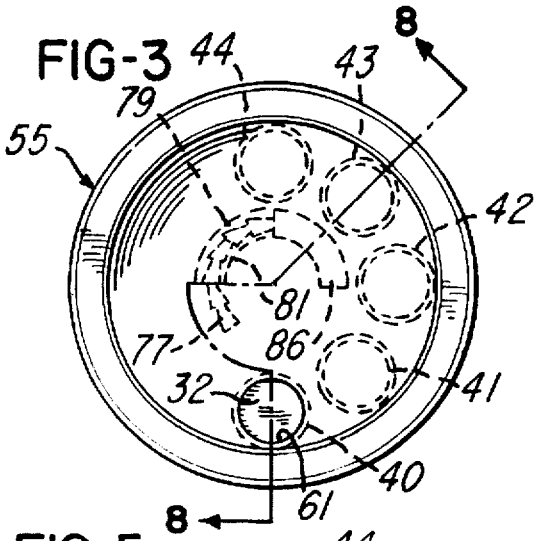
FIG. 3 is a top view of the container shown in FIG. 1 and illustrating the position of the closure when the container is shipped to a bottler.

The all plastic container 15 described above in connection with FIGS. 1–10, is preferably used in accordance with the following procedure. The container 15 is originally assembled as shown in FIGS. 1–3 wherein the opening 61 within the closure 55 is aligned with the annular lip seal 40 on the top end wall 10. The latch elements 77, 79 and 81 are in the position shown in FIG. 3 wherein one end of each latch elements 79 and 81 abuts one end of the arcuate stop element 86. This is the initial position when the container 15 is empty and shipped sealed to a bottler of a beverage.

Figure 4:
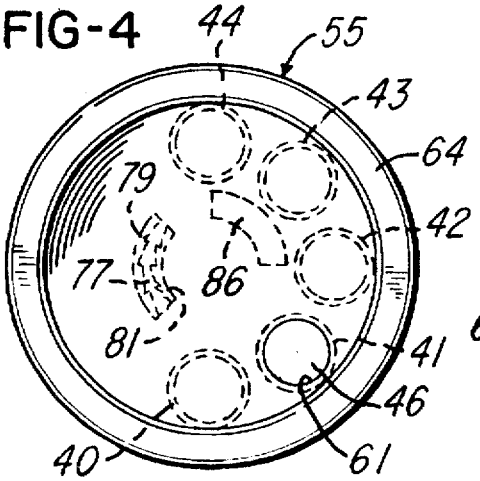
FIG. 4 is a view similar to FIG. 3 and illustrating the position of the closure for filling the container.

The bottler indexes the closure 55 counterclockwise by 45 degrees until the opening 61 aligns with the annular lip seal 41 and the opening 46 within the top end wall 10, as shown in FIG. 4. In this position, the bottler fills the container 15, after which the bottler indexes the closure 55 counterclockwise by another 45 degrees so that the opening 61 is aligned with the annular seal 42 (FIG. 5) where the container 15 is closed and sealed with the beverage within the container. In this position shown in FIG. 5, batches of the filled containers 15 are packaged and shipped by the bottler through conventional distribution channels to wholesale or retail stores or vending machine operators or such other locations where the containers are made available or offered for sale to consumers.

Figure 5:
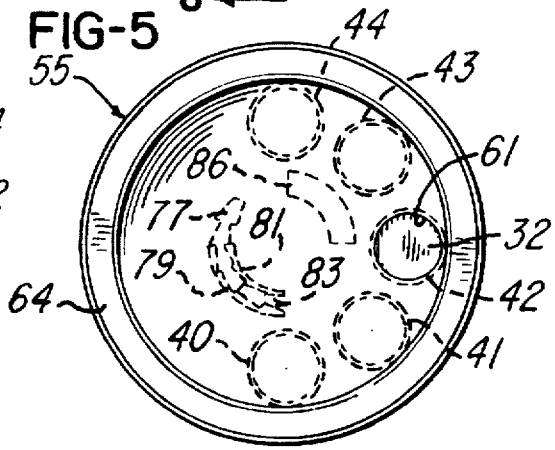
FIG. 5 is a view similar to FIG. 3 and illustrating the sealed position of the closure when the container is shipped from the bottler.
Figure 6:
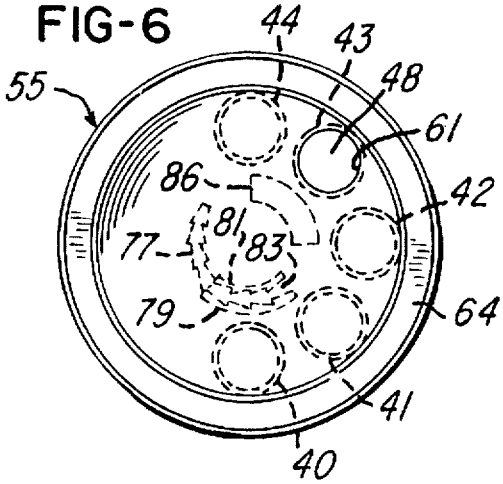
FIG. 6 is a view similar to FIG. 3 and illustrating the closure position when opened by a consumer.
Figure 7:
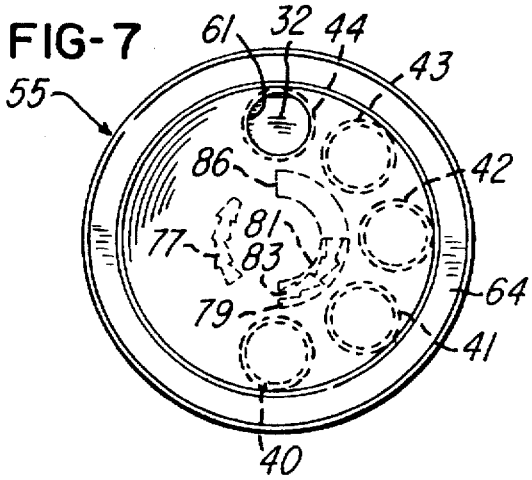
FIG. 7 is a view similar to FIG. 3 and illustrating the closure position when reclosed by the consumer.

When a consumer receives a filled container as shown in FIG. 5 and desires to open the container, the consumer rotates or indexes the closure 55 by another 45 degrees to position the opening 61 in alignment with the annular seal 43 and the opening 48 within the top end wall 10, as shown in FIG. 6. In this position, the latch element 77 has passed through the latch cavity 83, as also shown in FIG. 6. If the consumer does not drink or empty the entire contents or beverage from the container 15, the consumer may reclose the container by indexing the closure 55 again counterclockwise by another 45 degrees until the opening 61 is aligned with the annular seal 44 on top end wall, as shown in FIG. 7. In this position, the opposite ends of the latch elements 79 and 81 abut or engage the opposing end of the arcuate stop element 86 (FIG. 7) which prevents the closure 55 from being rotated further in a counterclockwise direction. However, the closure 55 may be rotated clockwise from the FIG. 7 position by 45 degrees when it is desired to reopen the container 15 by aligning the opening 61 again with the annular seal 43 and opening 48. In this position, the opposite ends of the arcuate latch elements 79 and 81 engage the opposing end of the arcuate latch element 77 to prevent further rotation of the closure 55 in a clockwise direction.

From the drawings and the above description, it is apparent that a container constructed in accordance with the present invention, provides desirable features and advantages. As one advantage, the container is constructed entirely of a rigid or semi-rigid plastics material such as the PET material. As another advantage, each of the lip seals 40–44 forms a positive fluid-tight seal with the rotatable closure 55, and each lip seal becomes more positive as the pressure within the container increases to assure that the container holds the pressure such as produced by a carbonated beverage. In additions the top end wall 10 and the closure 55 cooperate to provide a series of step-by-step positions for the closure opening 61 in order to offer the different positions described above in connection with FIGS. 3–7.

As another feature, the one-way latch 75 and stop 86 provide for a tamper-proof closure to assure a customer or consumer that the container has not been opened when the consumer receives the filled container with the closure 55 in the position shown in FIG. 5. If the closure is not in the FIG. 5 position, the consumer knows the container has been opened. Also, the injection molded ring 90 assures a positive fluid-tight connection of the top end wall 30 to the container body 18 and also cooperates with the closure 55 to provide a locked-on rotatable connection.

While the form of container herein described constitutes a preferred embodiment of the invention, it is to be understood that the invention is not limited to this precise form of container, and that changes may be made therein without departing from the scope and spirit of the invention as defined in the appended claims.

The invention having thus been described, the following is claimed:

1. A portable container adapted to receive and retain a fluid and to provide for conveniently opening and closing said container, comprising a hollow body defining a chamber for receiving the fluid and including an upper annular neck portion defining an open top for said body, a cap member covering said open top and including a peripheral portion adjacent said neck portion, a fluid-tight connection between said neck portion of said body and said peripheral portion of said cap member, a rotary closure member supported for rotation relative to said cap member and said body, said cap member and said closure member each being formed of a plastics material, an opening within said cap member and an opening within said closure member, said openings being generally aligned at a rotary open position of said closure member to provide for the free flow of fluid from said chamber, said openings being out of alignment at a first rotary closed position of said closure member, an annular sealing member between said closure member and said cap member and surrounding said opening within said cap member, said sealing member forming a fluid-tight seal between said closure member and said cap member, stop members for limiting rotation of said closure member after rotating said closure member from said first closed position to said open position, said closure member being rotatable to a second closed position closing said opening within said cap member, and said stop members provide for reverse rotation of said closure member between said second closed position and said open position.

2. A container as defined in claim 1 wherein said closure member includes a peripheral skirt portion having a bottom surface positioned adjacent an annular shoulder on said neck portion.

3. A container as defined in claim 1 wherein said stop members include a first member molded as an integral part of said closure member and a second member molded as an integral part of said cap member, and said first and second members have interfering rotary paths.

4. A container as defined in claim 1 wherein said sealing member comprises a tapered lip portion molded as an integral part of said cap member and projects radially inwardly around said opening within said cap member, and said lip portion is exposed to the pressure of the fluid within said chamber for pressing said lip portion against said closure member.

5. A portable container adapted to receive and retain a fluid and to provide for conveniently opening and closing said container, comprising a hollow body defining a chamber for receiving the fluid and including an upper annular neck portion defining an open top for said body, a cap member covering said open top and including a peripheral portion adjacent said neck portion, a fluid-tight connection between said neck portion of said body and said peripheral portion of said cap member, a rotary closure member supported for rotation relative to said cap member and said body, said cap member and said closure member each being formed of a plastics material, an opening within said cap member and an opening within said closure member, said openings being generally aligned at a rotary open position of said closure member to provide for the free flow of fluid from said chamber, said openings being out of alignment at a rotary closed position of said closure member, an annular sealing member between said closure member and said cap member and surrounding said opening within said cap member, said sealing member being molded as an integral part of said cap member and projecting upwardly to engage said closure member to form a fluid-tight seal between said closure member and said cap member, and stop members for limiting rotation of said closure member after rotating said closure member from said closed position to said open position.

6. A container as defined in claim 5 wherein said cap member, sealing member and said closure member comprise the same plastics material.

7. A portable container adapted to receive and retain a fluid and to provide for conveniently opening and closing said container, comprising a hollow body defining a chamber for receiving the fluid and including an upper annular neck portion defining an open top for said body, a cap member covering said open top and including a peripheral portion adjacent said neck portion, a fluid-tight connection between said neck portion of said body and said peripheral portion of said cap member, a rotary closure member supported for rotation relative to said cap member and said body, said cap member and said closure member each being formed of a plastics material, an opening within said cap member and an opening within said closure member, said openings being generally aligned at a rotary open position of said closure member to provide for the free flow of fluid from said chamber, said openings being out of alignment at a rotary closed position of said closure member, an annular sealing member between said closure member and said cap member and surrounding said opening within said cap member, said sealing member forming a fluid-tight seal between said closure member and said cap member, stop members for limiting rotation of said closure member after rotating said closure member from said closed position to said open position, and said stop members prevent rotation of said closure member to said closed position after said openings are generally aligned at said open position.

8. A portable container adapted to receive and retain a fluid and to provide for conveniently opening and closing said container, comprising a hollow body defining a chamber for receiving the fluid and including an upper annular neck portion defining an open top for said body, a cap member covering said open top and including a peripheral portion connected to said neck portion with a fluid-tight connection, a rotary closure member mounted on said cap member for rotation relative to said cap member and said body, said cap member and closure member each being formed of a plastics material, an opening within said cap member and an opening within said closure member, said openings being generally aligned at a rotary open position of said closure member to provide for the free flow of fluid from said chamber, said openings being out of alignment at first and second rotary spaced closed positions of said closure member, an annular sealing member between said closure member and said cap member and surrounding said opening within said cap member, said sealing member forming a fluid-tight seal between said closure member and said cap member, and stop members for preventing rotation of said closure member to said first closed position after rotating said closure member to said open position.

9. A container as defined in claim 8 wherein said rotary closure member includes a peripheral skirt portion surrounding said cap member, and said skirt portion forms a snap-fit connection of said closure member with said cap member.

10. A container as defined in claim 8 wherein said closure member includes a peripheral skirt portion having a bottom surface positioned adjacent an annular shoulder on said neck portion.

11. A container as defined in claim 8 wherein said annular sealing member is molded as an integral part of said cap member and projects upwardly to engage said closure member.

12. A container as defined in claim 8 wherein said stop members include a first member molded as an integral part of said closure member and a second member molded as an integral part of said cap member, and said first and second members have cam surfaces and interfering rotary paths.

13. A container as defined in claim 8 wherein said neck portion defines an external annular recess, and said cap member includes an annular portion projecting inwardly into said recess.

14. A portable container adapted to receive and retain a fluid and to provide for conveniently opening and closing said container, comprising a hollow body of blow-molded plastics material and defining a chamber for receiving the fluid, said body including an upper annular neck portion defining an open top for said body, a cap member covering said open top and including a peripheral portion connected to said neck portion with a fluid-tight connection, a rotary closure member mounted on said cap member for rotation relative to said cap member and said body, said cap member and closure member each being formed of a molded plastics material, an opening within said cap member and an opening within said closure member, said openings being generally aligned at a rotary open position of said closure member to provide for the free flow of fluid from said chamber, said openings being out of alignment at first and second rotary spaced closed positions of said closure member, an annular sealing member molded as an integral part of said cap member and surrounding said opening within said cap member, said sealing member projecting upwardly to engage said closure member and forming a fluid-tight seal between said closure member and said cap member, and stop members extending between said cap member and said closure member for preventing rotation of said closure member to said first closed position after rotating said closure member to said open position.

* * * * *